US011840383B2

(12) United States Patent
Peterson

(10) Patent No.: US 11,840,383 B2
(45) Date of Patent: Dec. 12, 2023

(54) EDIBLE MATERIAL DISPENSING TAB FOR BEVERAGE

(71) Applicant: Russ Lynn Peterson, Missoula, MT (US)

(72) Inventor: Russ Lynn Peterson, Missoula, MT (US)

( * ) Notice: Subject to any disclaimer, the term of this patent is extended or adjusted under 35 U.S.C. 154(b) by 0 days.

(21) Appl. No.: 17/510,067

(22) Filed: Oct. 25, 2021

(65) Prior Publication Data

US 2022/0127051 A1 Apr. 28, 2022

Related U.S. Application Data

(60) Provisional application No. 63/104,717, filed on Oct. 23, 2020.

(51) Int. Cl.
*B65D 51/28* (2006.01)
*B67B 7/40* (2006.01)

(52) U.S. Cl.
CPC ..... *B65D 51/2892* (2013.01); *B67B 7/403* (2013.01)

(58) Field of Classification Search
CPC ..... B65D 51/2892; B65D 81/3205; B65D 81/3216; B65D 17/521; B65D 17/4012
USPC ..... 206/219, 220, 222; 220/258.4
See application file for complete search history.

(56) References Cited

U.S. PATENT DOCUMENTS 4,078,693 A 3/1978 Asbury
4,585,140 A 4/1986 Lambert et al.
5,695,085 A 12/1997 Hadener
5,775,205 A 7/1998 Melton
5,819,923 A * 10/1998 Spring ..... B65D 81/3205 220/258.4
5,885,635 A * 3/1999 Spring ..... B65D 81/3222 426/115
5,952,028 A 9/1999 Lesser
6,165,523 A 12/2000 Story
7,017,735 B2 3/2006 Carlson
7,175,049 B2 2/2007 Kastenschmidt et al.
7,690,534 B2 4/2010 Revenu
7,896,154 B2 * 3/2011 Boatner ..... B65D 17/4014 206/221
8,469,186 B2 * 6/2013 Pradeep ..... B65D 25/08 426/115
9,327,881 B1 5/2016 Saranga et al.
9,884,701 B2 2/2018 Forrest et al.
10,112,752 B2 10/2018 Tonn et al.
10,556,718 B2 2/2020 Scott
(Continued)

OTHER PUBLICATIONS

"11 Ways to Stop Companies From Ripping Off Your Invention." YouTube. Dec. 20, 2018. Web. Accessed on Apr. 16, 2022.
(Continued)

*Primary Examiner* — Steven A. Reynolds
(74) *Attorney, Agent, or Firm* — MUGHAL GAUDRY & FRANKLIN PC

(57) ABSTRACT

A can-top reservoir attached to a lid of a beverage container is provided. The pull tab is used for opening a beverage container and dispensing edible material into the beverage container. The pull tab comprises a reservoir for storing an edible material, different than the beverage container. The reservoir is provided with a sealing element which when manipulated to selectively dispense the edible material from the reservoir to the mouth of the beverage container via an egress of the reservoir.

20 Claims, 15 Drawing Sheets

(56) References Cited

U.S. PATENT DOCUMENTS

| | | | | |
|---|---|---|---|---|
| 2002/0151970 | A1* | 10/2002 | Garrison | A61F 2/2433 623/2.14 |
| 2002/0157970 | A1 | 10/2002 | Carlson | |
| 2008/0223741 | A1 | 9/2008 | Nyambi et al. | |
| 2010/0012660 | A1 | 1/2010 | Morini et al. | |
| 2010/0187257 | A1 | 7/2010 | Roth et al. | |
| 2010/0224511 | A1* | 9/2010 | Boatner | B65D 25/08 220/270 |
| 2013/0240535 | A1* | 9/2013 | Grajqevci | B65D 47/265 220/524 |
| 2015/0053702 | A1 | 2/2015 | Brewster et al. | |
| 2015/0076012 | A1 | 3/2015 | Davis et al. | |
| 2017/0225212 | A1 | 8/2017 | Wong et al. | |
| 2018/0327142 | A1* | 11/2018 | Nikolic | B65D 25/08 |

OTHER PUBLICATIONS

"26 Sourcing Terms You Should Know in the Beverage Industry." BevSource. Web. Accessed on Apr. 16, 2022.
Schroeder. "A Clino-cladistic look at pull & push tap patents ca. 1950-19850." Web. Accessed on Apr. 16, 2022.
"Aluminum Alloy Research and Development Laboratory." TRL. Web. Accessed on Apr. 16, 2022.
"Beverage Cans—Canpack." Canpack. Web. Accessed on Apr. 16, 2022.
Grace. "Beverage Cans getting some clear and resealable options." Web. Accessed on Apr. 16, 2022.
"Beverage Industry Insights." BevSource. Web. Accessed on Apr. 16, 2022.
"Brite Cans." American Canning. Web. Accessed on Apr. 16, 2022.
"Can Central: Everything you need to know about cans." Can Manufacturers Institute. Web. Accessed on Apr. 16, 2022.
"Cannabinoids." Prepared Foods. Web. Accessed on Apr. 16, 2022.
"Click Cap resealable beverage end study shared with canmakers." The Canmaker. Web. Accessed on Apr. 16, 2022.
Maybach. "Coca-Cola Logo History." Turbologo. Web. Accessed on Apr. 16, 2022.
"Coca-Cola Logo Evolution." Turbologo. Web. Accessed on Apr. 16, 2022.
"Coca-Cola Logo." Google Search. Web. Accessed on Apr. 16, 2022.
Woodard. "Constellation Brands Performance Trends 2017-2021—results data." Just Drinks. Web. Accessed on Apr. 16, 2022.
"FDA Approved Plastics for Food Contact—Which Plastics Make the Cut?" A&C Plastics. Web. Accessed on Apr. 16, 2022.
"Global Food & Beverage Metal Cans Industry (2020 to 2025)." GlobeNewswire. Web. Accessed on Apr. 16, 2022.
"Home." Packaging World. Web. Accessed on Apr. 16, 2022.
"Light Beer Market Assessed to Experience a Hike in Growth By 2030—ABInBev, MillerCoors, Heineken USA." Digital Journal. Web. Accessed on Apr. 16, 2022.
"Member Companies." Can Manufacturers Institute. Web. Accessed on Apr. 16, 2022.
"We Formulate Ideas for the Food Industry & Beyond." Mile High Food Science. Web. Accessed on Apr. 16, 2022.
"Miller Lite created a buzz with 'beer drops.' This Upstate NY entrepreneur beat them to it." Syracuse.com. Web. Accessed on Apr. 16, 2022.
Schaltegger. "Miller Lite Launches 'Beer Drops' to Enhance Other Light Beers." Thrillist. Web. Accessed on Apr. 16, 2022.
"Ninth Planet Beverage Solutions." Ninth Planet Bev. Web. Accessed on Apr. 16, 2022.
"Operational services to support every step in production . . . & beyond." BevSource. Web. Accessed on Apr. 16, 2022.
"Aluminium cans." Orora Group. Web. Accessed on Apr. 16, 2022.
"Plastics vs. Polymers: What's the Difference?" OMICO Plastics, Inc. Web. Accessed on Apr. 16, 2022.
"Revolutionary Spill-proof, No Tab, Resealable Aluminum Can Top." Popseal. Web. Accessed on Apr. 16, 2022.
"Reclosable Cans and the Can End as Marketing Tool." Best in Packaging. Web. Accessed on Apr. 16, 2022.
"RTD Coffee Cup Holds Coffee and a Snack." Packaging Strategies. Mar. 8, 2018. Web. Accessed on Apr. 16, 2022.
"The Best Eco-Friendly Alternatives for the Plastic in Your Life." Eartheasy Guides & Articles. Web. Accessed on Apr. 16, 2022.
"The Evolution of Lids." Edible Geography. May 9, 2011. Web. Accessed on Apr. 16, 2022.
"The Secret Advantage of Cans of Coors Light." Cockeyed.com. Nov. 22, 2013. Web. Accessed on Apr. 16, 2022.
"Thermo ScientificThermo-Seal Heat Sealing Foil for ALPS 25 Automated Laboratory." Fisher Scientific. Web. Accessed on Apr. 16, 2022.
"What's Up With the Lip Guard?" 1335 Frankford. Aug. 22, 2017. Web. Accessed on Apr. 16, 2022.
Tanzilo. "When Milwaukee's Best is too rich for your wallet . . . " OnMilwaukee.com. Apr. 13, 2022. Web. Accessed on Apr. 16, 2022.
"Relock Revolution." Xolution. Web. Accessed on Apr. 16, 2022.
"A Smoother Pour with Crown's Global Vent™." *Global Vent*. Crown, n.d. Web. Feb. 4, 2022.

* cited by examiner

EDIBLE MATERIAL DISPENSING TAB FOR BEVERAGE

This application claims the benefit of and is a non-provisional of co-pending U.S. (Provisional) Application Ser. No. 63/104,717 filed on Oct. 23, 2020, which is hereby expressly incorporated by reference in its entirety for all purposes.

A portion of the disclosure of this patent document contains material, which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND

This disclosure relates in general to beverage containers and, not by way of limitation, to dispensing edible material in the beverage containers amongst other things.

Beverages are often sold in aluminum cans. Aluminum cans have many beneficial aspects, including that they can be efficiently manufactured in high volume, and are recyclable. These cans have different sizes and different capacities and are especially useful for storing and transporting carbonated beverages such as soda or beer, in which case the interior of can be pressurized.

While such beverage aluminum cans have advantages, they also have shortcomings. For example, individual can hold one beverage, with no ability for changing or customizing the beverage. Customizing of the beverage can be entailed, for example, when for example, a person wants to mix two drinks. Alternatively, customize the beverage can be entailed if a person wants to add any dry substance (for example, salt) in the beverage to make it more palatable. Any variation in beverage entails a separate production run of a separate stocking unit. Thus, there is a need for additional flexibility in the use of beverage cans and other beverage containers so that the beverage can be customized and made more palatable.

SUMMARY

In one embodiment, the present disclosure provides a pull tab attached to a lid of a beverage container is provided. The pull tab is used for opening a beverage container and dispensing edible material into the beverage container. The pull tab comprises a reservoir for storing an edible material, different than the beverage container. The reservoir is provided with a sealing element which when manipulated dispenses the edible material from the reservoir to a mouth of the beverage container via an egress of the reservoir.

In one embodiment, a pull tab for opening a beverage container and dispensing edible material into the beverage container. The pull tab comprises a reservoir, wherein the reservoir holds the edible material, different than a beverage of the beverage container, the reservoir has an egress for selectively dispensing the edible material into a mouth of the beverage container. The pull tab further comprises a sealing element for sealing the reservoir, wherein when the pull tab is lifted at an angle and the sealing element is manipulated, the edible material from the reservoir is dispensed into the beverage via the egress toward the mouth.

In another embodiment, a lid for covering a beverage container and dispensing edible material into the beverage container is provided. The lid comprises a reservoir, wherein the reservoir holds the edible material, different than a beverage of the beverage container and the reservoir has an egress for selectively dispensing the edible material into a mouth of the beverage container. The lid further comprises a sealing element for sealing the reservoir.

In yet another embodiment, a beverage container for holding a beverage is provided. The beverage container comprises a container body for holding the beverage, a lid coupled to the container body, and a pull tab, attached to the lid, for opening a beverage container and dispensing edible material into the beverage container. The pull tab comprises a reservoir, wherein the reservoir holds the edible material, different than a beverage of the beverage container, the reservoir has an egress for selectively dispensing the edible material into a mouth of the beverage container. The pull further comprises a sealing element for sealing the reservoir, wherein when the pull tab is lifted at an angle and the sealing element is manipulated, the edible material from the reservoir is dispensed into the beverage via the egress toward the mouth.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

In the appended figures, similar components and/or features may have the same reference label. Where the reference label is used in the specification, the description is applicable to any one of the similar components having the same reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment (s) will provide those skilled in the art with an enabling description for implementing a preferred exemplary embodiment. It is understood that various changes may be made in the function and arrangement of elements without departing from the spirit and scope as set forth in the appended claims.

Figure 1:
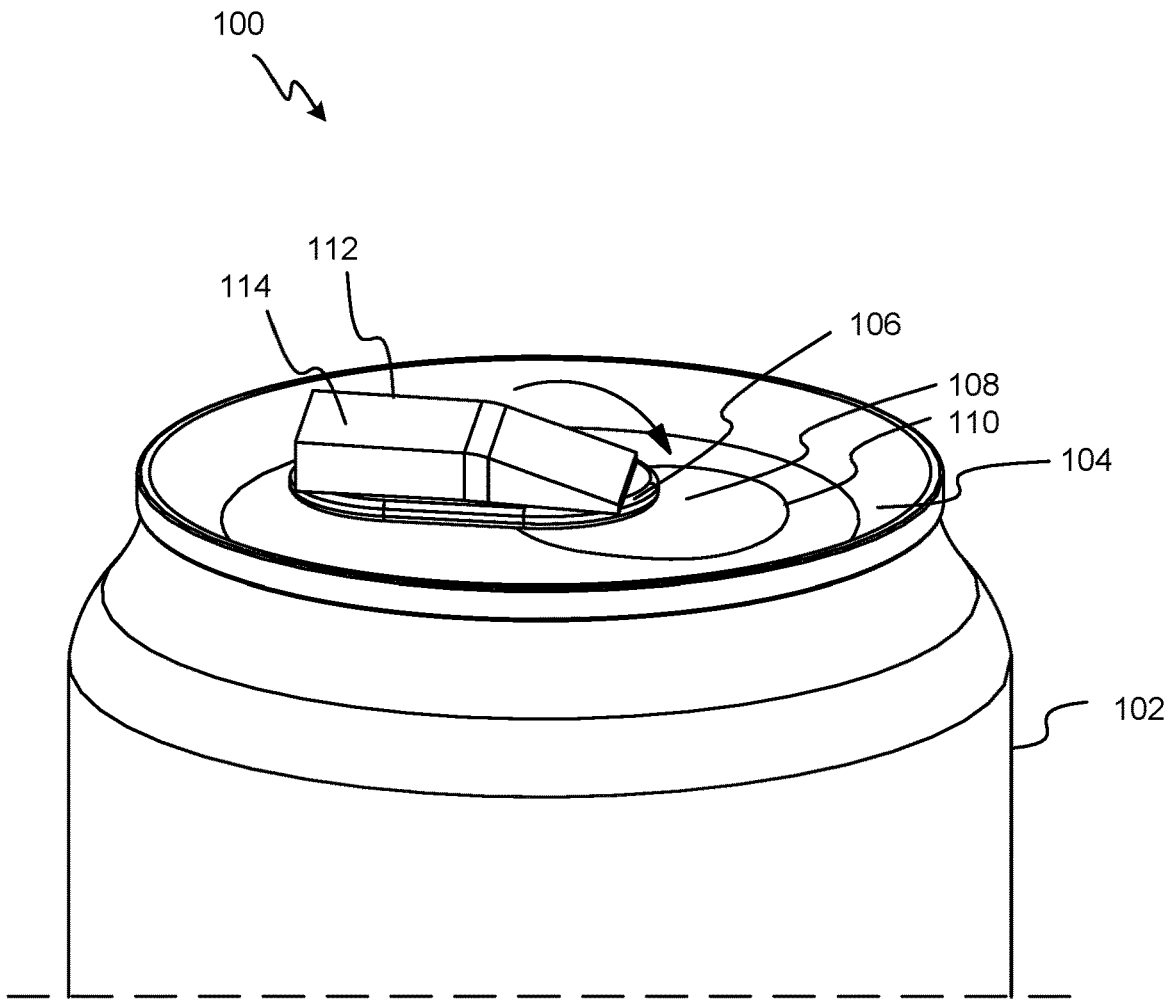
FIG. 1 depicts an exemplary embodiment of a beverage container, in accordance with one embodiment of the present disclosure.

Referring to FIG. 1, a beverage container 100 is illustrated, in accordance with some embodiment of the present disclosure. The beverage container 100 is an aluminum can, be recognized that the disclosure can be embodied in or with other kinds of beverage containers, and in or with containers for liquids apart from beverages. The beverage container 100 holds a quantity of a beverage, for example, soda, beer, carbonated water, seltzer, or another beverage. While cans are often used with carbonated beverages, the disclosure is not so limited to use with carbonated beverages.

Beverage container 100 can include a container body 102, a lid 104 joined to the container body 102, and a pull tab 106 (or can-top reservoir) attached to the lid 104 via a rivet. The lid 104 has a mouth 108 enclosed by a weakened perimeter 110 formed in the aluminum material of the lid 104. In one embodiment, the container body 102 and the lid 104 are typically manufactured separately and joined together after the container body 102 is filled with a beverage. The perimeter of lid 104 is then sealed to the upper perimeter of can body 102.

When a user desires to consume a beverage stored in the beverage container 100, the user lifts a pull tab 106, which in turn lifts the rivet, breaking a small hole in the lid 104. Upon further lifting of the pull tab 106, a front edge of the pull tab 106 forces a breakaway portion 110 (mouth of the beverage container 100) downward into the beverage container 100. The pull tab 106 can then be pushed back down into near contact with the lid 104, leaving a nearly-unobstructed aperture through which the beverage contained in the beverage container 100 can be consumed.

The pull tab 106 has a reservoir 112 for holding an edible material. The edible material can include a fluid or a dry substance which can be selectively added to the beverage present in the beverage container 100. This would mean that the edible material is added as and when desired by the user. This permits the user to customize the beverage according to taste. Reservoir 112 can form a hollow tub-like structure on the pull tab 106 for holding the edible material. In one embodiment, the pull tab 106 and the reservoir 112 have branding of the manufacturer who is manufacturing the beverage container 100. The branding may include an advertisement from the manufacturer manufacturing the beverage container 100. In other embodiment, the pull tab 106 and the reservoir 112 have branding other than that of the manufacturer who is manufacturing the beverage container 100.

The edible material can be, for example, a flavoring additive, a colorant, or another kind of additive that can be dispensed into beverage present in the beverage container 100 to modify a characteristic of the beverage. For example, the edible material can comprise a citrus flavoring, a seafood flavoring, or another kind of flavoring. In other examples, edible material can include cannabidiol (CBD), tetrahydrocannabinol (THC), one or more terpenes, or another kind of additive. In another example, beverage in the beverage container 100 can be non-caffeinated, and edible material can include caffeine. In other examples, the edible material can be a dry substance, for example, salt, chili powder, etc. In other examples, the edible material can be in the form of a capsule (for example, a caffeine capsule).

Figure 4:
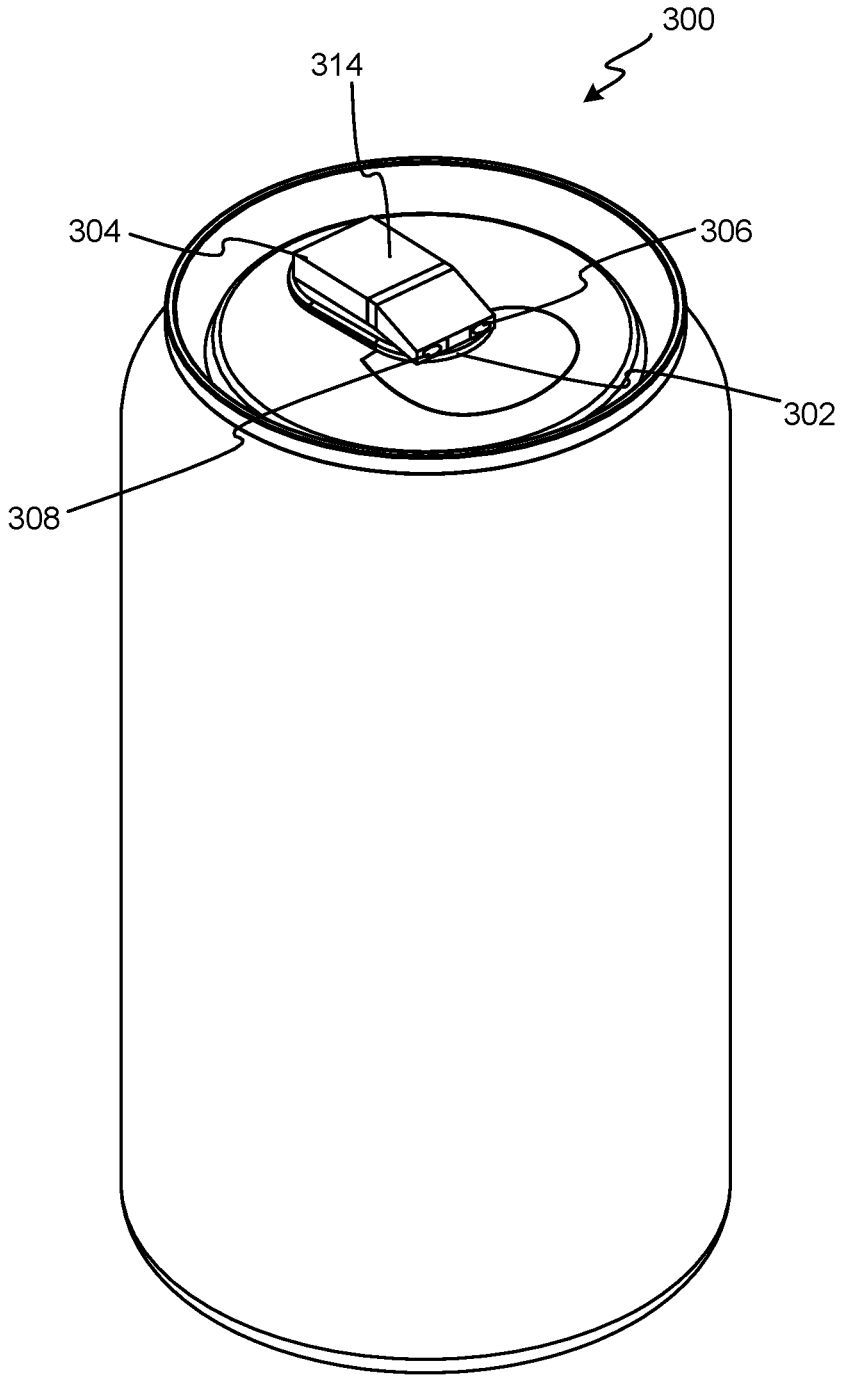
FIG. 4 illustrates a non-enlarged view of the beverage container having two egresses, in accordance with one embodiment of the present disclosure.

The reservoir 112 has either a one egress (as in FIG. 2) or multiple egresses (as illustrated in the FIG. 4). The egresses are the outlets from where the edible material present inside the reservoir 112 is dispensed into the beverage container 100. The reservoir 112 is covered by a sealing element 114. The sealing element 114 can be made of different materials, for example, plastic, aluminum, a food-grade polymer, or another suitable material, and can be adhered, welded, or otherwise attached to the reservoir 112.

The sealing element 114 is manipulated by different means. In one embodiment, the sealing element 114 can be manipulated by breaking the sealing element 114. In other words, the sealing element 114 can be broken as and when the user desires to mix the edible material into the beverage present in the beverage container 100. In another embodiment, the sealing element 114 is manipulated by lifting the pull tab 106 at an angle. In other words, the sealing element 114 can be coupled with the pull tab 106 and when the pull tab 106 is lifted at an angle, the sealing element 114 is stretched which creates a manipulation in the sealing element 114. In another embodiment, the sealing element 114 is manipulated upon squeezing the sealing element 114. In another embodiment, the sealing element 114 is manipulated by pushing the sealing element 114 in a downward direction.

In one embodiment, the sealing element 114 can be manipulated manually by manual pressure exerted by a user's finger or thumb, or through the use of a tool, for example a key, a spoon, a knife, a coin, or any other suitable and preferably conveniently-available tool. In some embodiments, a user can rotate the pull tab into position which is on top of the reservoir and press down in the pull tab, which can be more comfortable or effective than direct manual contact with reservoir.

The reservoir 112 can include a passage that can connect the reservoir 112 with the egress. The passage can be in the form of a channel from where the edible material present in the reservoir 112 can be dispensed into the beverage container 100 via the mouth 108 of the beverage container 100 when the pull tab 106 is lifted at an angle. In one embodiment, the angle can be 45 degrees. In another embodiment, the angle can be 90 degrees. However, the values of the angle are not limited to the one mentioned here and can include any value. The arrow in FIG. 1 shows the lifting of the pull tab 106 at an angle.

Thus, when the pull tab 106 is lifted at an angle (for example, at 90 degrees) and the sealing element 114 is manipulated, the edible material (for example, fluid) travels in the middle of the reservoir and downwards towards the egress via the passage. The passage in the reservoir 112 provides a directed flow to the edible material and letting the edible material spill outside the reservoir 112. From the egress, the edible material is dispensed directly into the beverage container 100 via mouth 108 of the beverage container 100.

A user who desires to consume beverage from the beverage container 100 can interact with the beverage container by manipulating the sealing element 114. Once the sealing element 114 is manipulated (in any of the ways mentioned above), the edible material can be added to the beverage present in the beverage container 100 and the user can consume a modified beverage.

Figure 2:
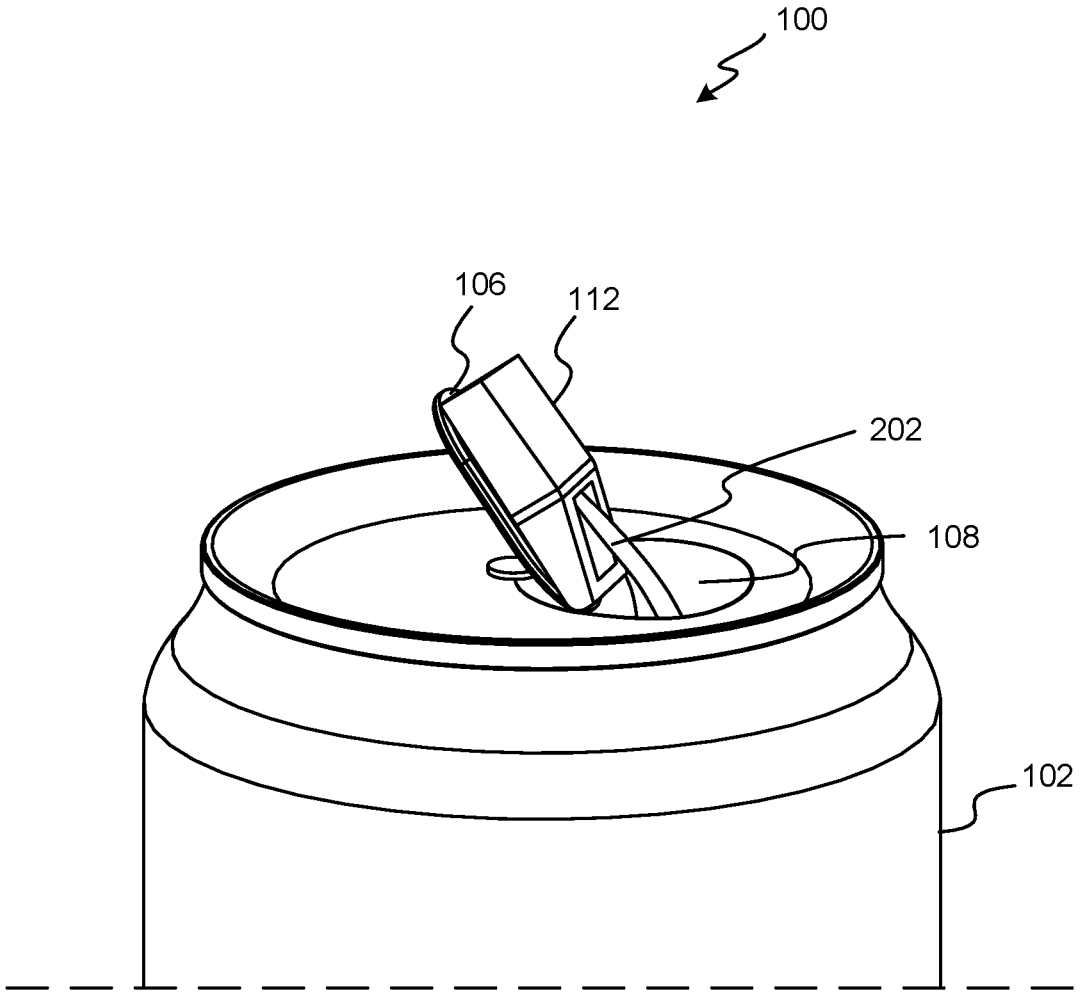
FIG. 2 illustrates dispensing of the edible material into the beverage container, in accordance with one embodiment of the present disclosure.

FIG. 2 shows dispensing of the edible material 202 (fluid in this case) into the beverage container 100 via the mouth 108 of the beverage container 100. The edible material is dispensed at an angle such as to prevent edible material from spilling outside the beverage container 100. As the angle of the pull tab 106 changes, the angle at which the edible material dispenses from the reservoir 112 into the beverage container 100 also changes. In one embodiment, a bottom side of the pull tab 106 can be pushed further inside the beverage container 100. This will enable dispensing of the edible material into the beverage container 100 more effectively when the sealing element 114 is manipulated.

Figure 3:
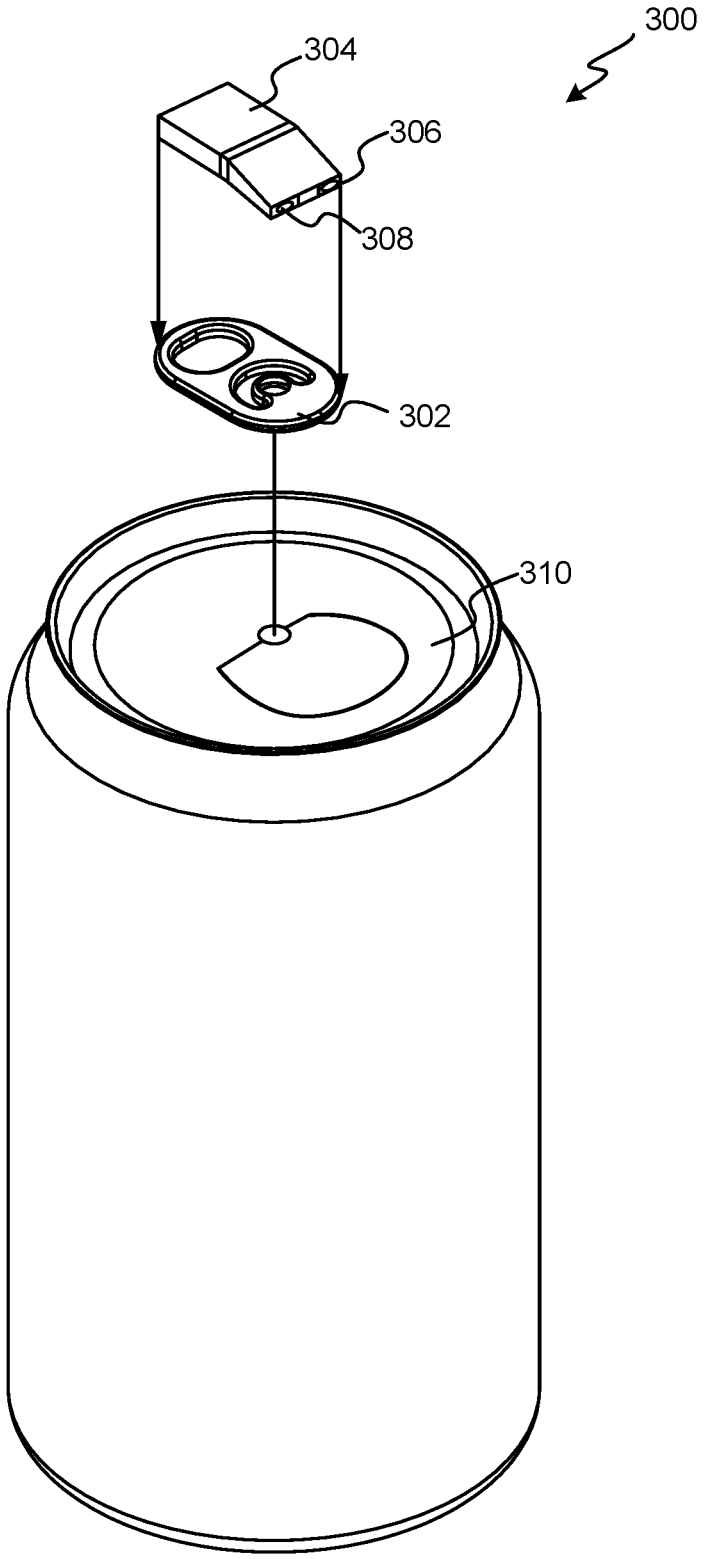
FIG. 3 illustrates an enlarged view of the pull tab and the reservoir present on the pull tab, in accordance with one embodiment of the present disclosure.

Referring to FIG. 3 now, an enlarged view of a beverage container 300 with a pull tab 302 and a reservoir 304 present on the pull tab 302 is shown, in accordance with some embodiment of the present disclosure. The reservoir 304 in this embodiment has two egress 306 and 308. Hence, according to this embodiment, when the pull tab 302 is lifted at an angle, the edible material present in the reservoir 304 dispenses out from the two egresses 306, 308 via two channels. Also, as explained above, the pull tab 302 is attached to a lid 310 of the beverage container 300 via a rivet 312. The beverage container 300 can also comprise a rivet. In one embodiment, the rivet can be separately provided on the lid 310 or can be made from a material of the lid 310.

FIG. 4 illustrates the beverage container 300 showing egresses 306, 308 in the reservoir 304 present on pull tab 302, according to some embodiment of the present disclosure. The egresses 306, 308 can be present at two corners of the reservoir 304 such that in place of edible material falling into the beverage container from the middle of the reservoir 304 (as shown in FIG. 2), the edible material falls into the beverage container 300 through the two sides of the reservoir 304. The reservoir 304 has a covering of sealing element 314 for protecting the edible material present in the reservoir 304.

Figure 5:
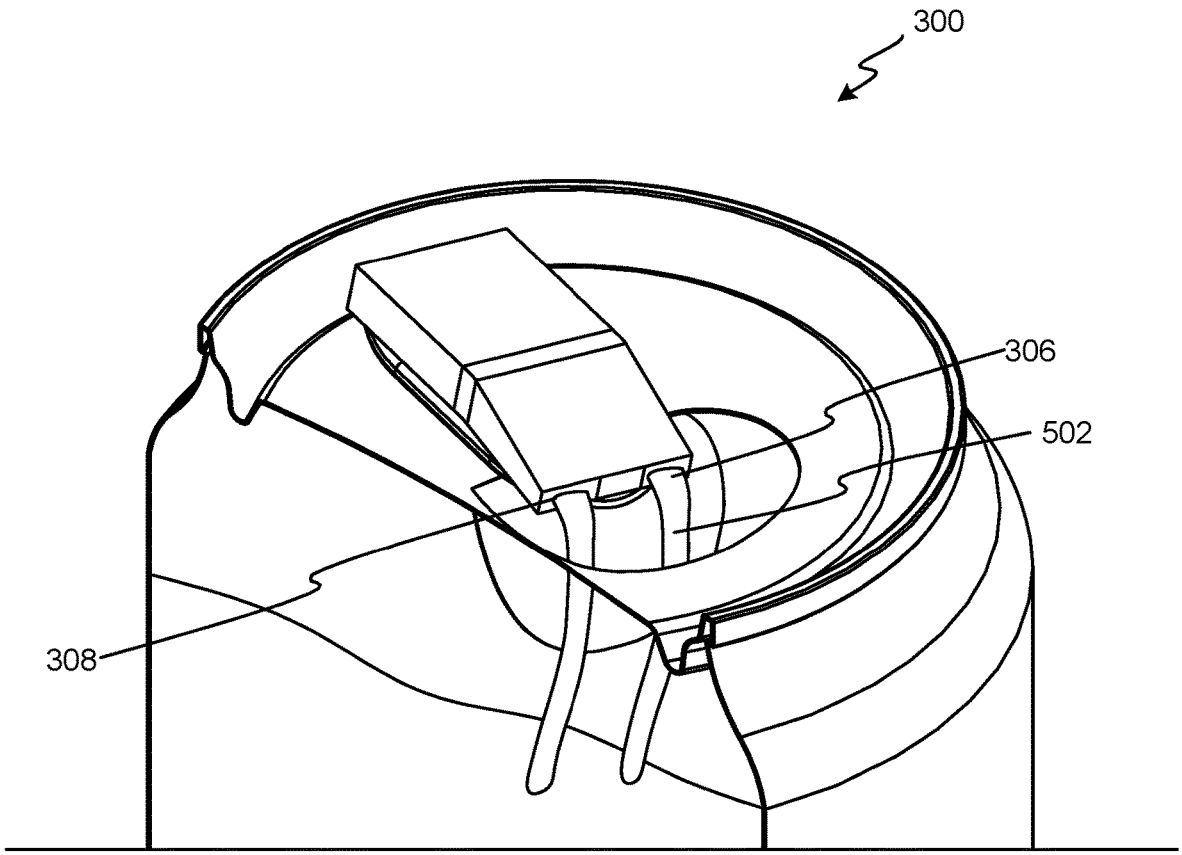
FIG. 5 illustrates dispensing edible material into the beverage container via two egresses, in accordance with one embodiment of the present disclosure.
Figure 6:
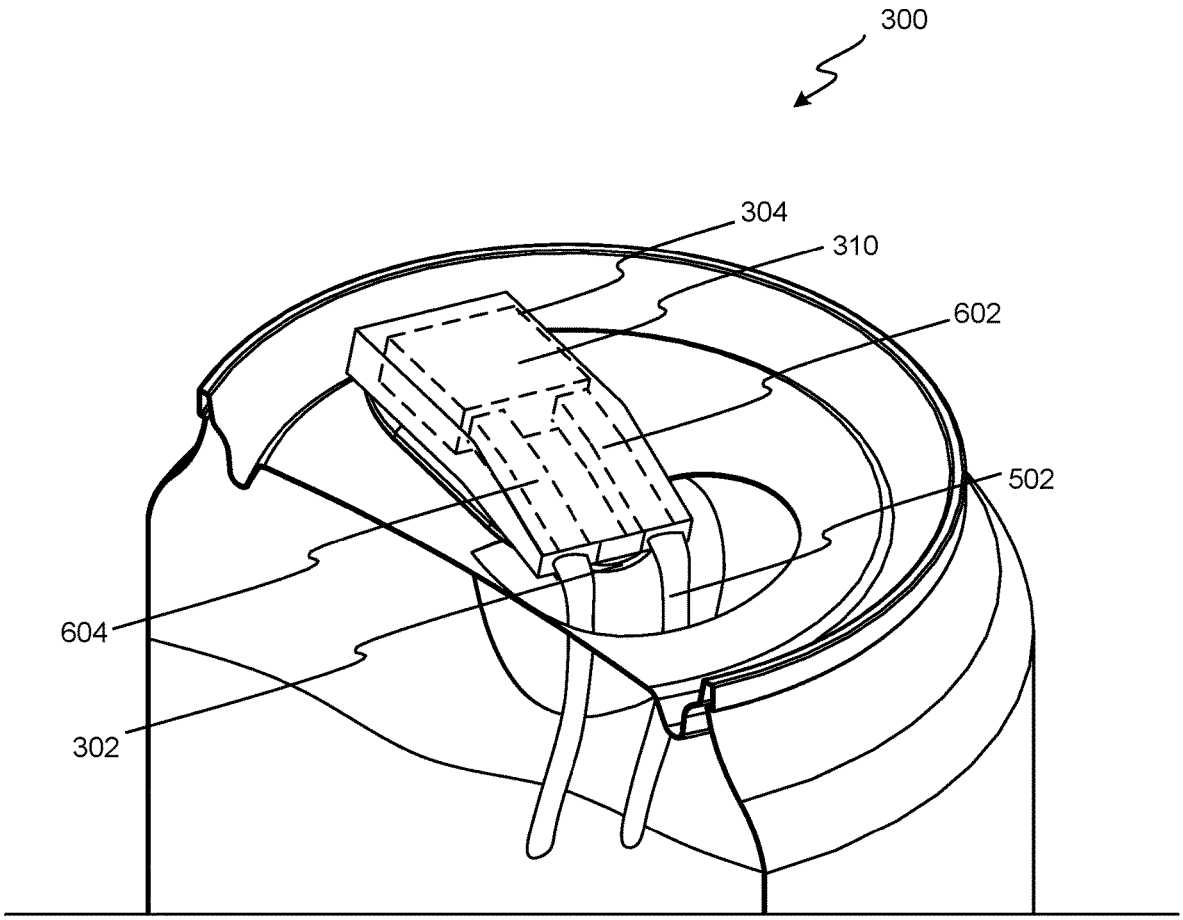
FIG. 6 illustrates an embodiment of dispensing edible material into the beverage container via two egresses, in accordance with another embodiment of the present disclosure.

FIG. 5 and FIG. 6 illustrates dispensing of edible material 502 into the beverage container 300 via egresses 306 and 308, in accordance with some embodiment of the present disclosure. While FIG. 5 illustrates dispensing of edible material (fluid in this case), FIG. 6 illustrates a cross-section view of the reservoir 304 showing channels 602 and 604 via which the edible material is dispensed into the beverage container 300.

The two channels 602 and 604, present on the opposite side of the reservoir 304, connects the reservoir 304 to egresses 306, and 308. Thus, when the pull tab 302 is lifted at an angle and the sealing element 314 is manipulated in one of the ways mentioned above, the edible material dispenses out from the two channels 602, 604 present on the opposite sides of the reservoir 304. In one embodiment, the position of the two channels 602 and 604 is not restrictive. The channels 602 and 604 provide for a more efficient way of dispensing the edible material into the beverage container 300. In other words, dispensing of the edible material via the channels 602 and 604 ensures that the edible material does not spill out of the reservoir 304 and the whole edible material is dispensed into the beverage container 300 with no wastage.

Figure 7:
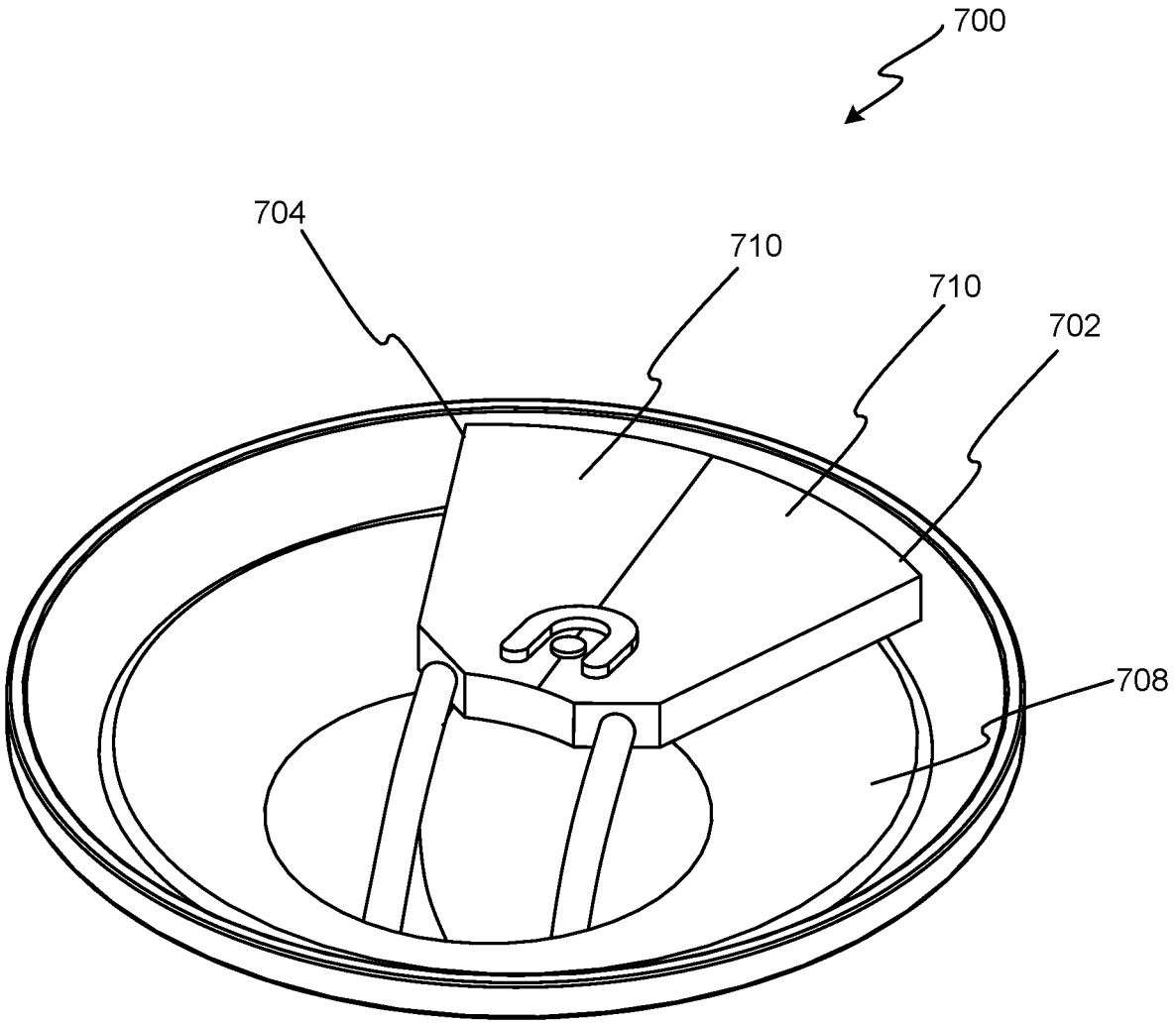
FIG. 7 illustrates a beverage container having two reservoirs, in accordance with one embodiment of the present disclosure.

Referring to FIG. 7 now, a beverage container 700 with two reservoirs 702 and 704, in accordance with some embodiment of the present disclosure. The shape of the two reservoir 702 and 704 is not limited to the one mentioned here, and the reservoirs 702 and 704 can take any shape. In one embodiment, the beverage container 700 does not include pull tab and the two reservoirs 702, 704 can be present directly on a lid 708 beverage container 700.

The two reservoirs 702 and 704 can include two different types of edible material. For example, one reservoir can comprise lemon juice while the other reservoir can comprise seafood flavoring. In one embodiment, one reservoir can include lemon juice while the other can include dry substances (for example, salt). In yet another embodiment, one reservoir can include lemon juice while the other can include caffeine capsules. However, any such combination of two edible materials is possible for two reservoirs.

Reservoirs are covered by sealing elements 710. In one embodiment, the sealing elements 710 can be of different material based on the type of edible material present in the reservoir 702 and 704. Reservoirs 702, 704 has at least one channel from which the edible material can be dispensed into the mouth of the beverage container 700. Either of the edible material can be dispensed into the beverage container 700 by manipulating the sealing element present in the reservoir 702, 704. For example, the user can manipulate (deform, press, remove) the sealing elements 710 from either of the reservoir from which the user desires to mix the edible material into the beverage container 700.

Figure 8:
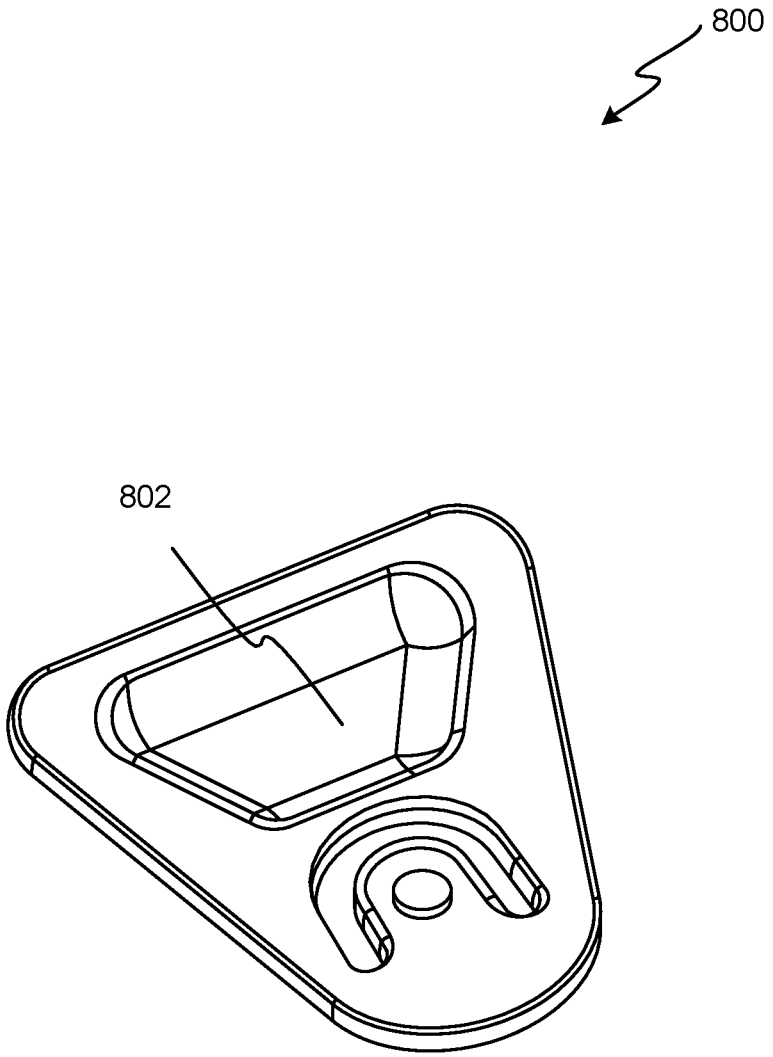
FIG. 8 illustrates a reservoir placed on the pull tab for storing the dry substance, in accordance with one embodiment of the present disclosure.

Referring to FIG. 8, a pull tab 800 comprising a reservoir 802 placed on a pull tab 800 for storing the dry substance, is shown in accordance with some embodiment of the present disclosure. The reservoir 802 is shown as a tub-like structure that can accommodate dry substance. In one embodiment, the dry substance can be salt. In one embodiment, the dry substance can be chili powder. Reservoir 802 is covered by a sealing element. The sealing element can be made of aluminum, plastic, or any food-grade material. The reservoir 802 is placed on the pull tab 800 with a rivet in between. The rivet helps connect the pull tab with the lid.

A user can desire to mix the dry substance, for example, salt in the beverage present in a beverage container. The dry substance can be mixed in the beverage to make the beverage more palatable. Whenever the user desires to mix the dry substance in the beverage container, pull tab 800 can be lifted at an angle and the sealing element is manipulated, the dry substance can be dispensed into the beverage container via the mouth of the beverage container. In one embodiment, the dry substance can be dispensed via a channel present in the reservoir 802. In another embodiment, the user can dispense the dry substance by taking a pinch of dry substance using his fingers and dispensing it into the beverage container.

Figure 9:
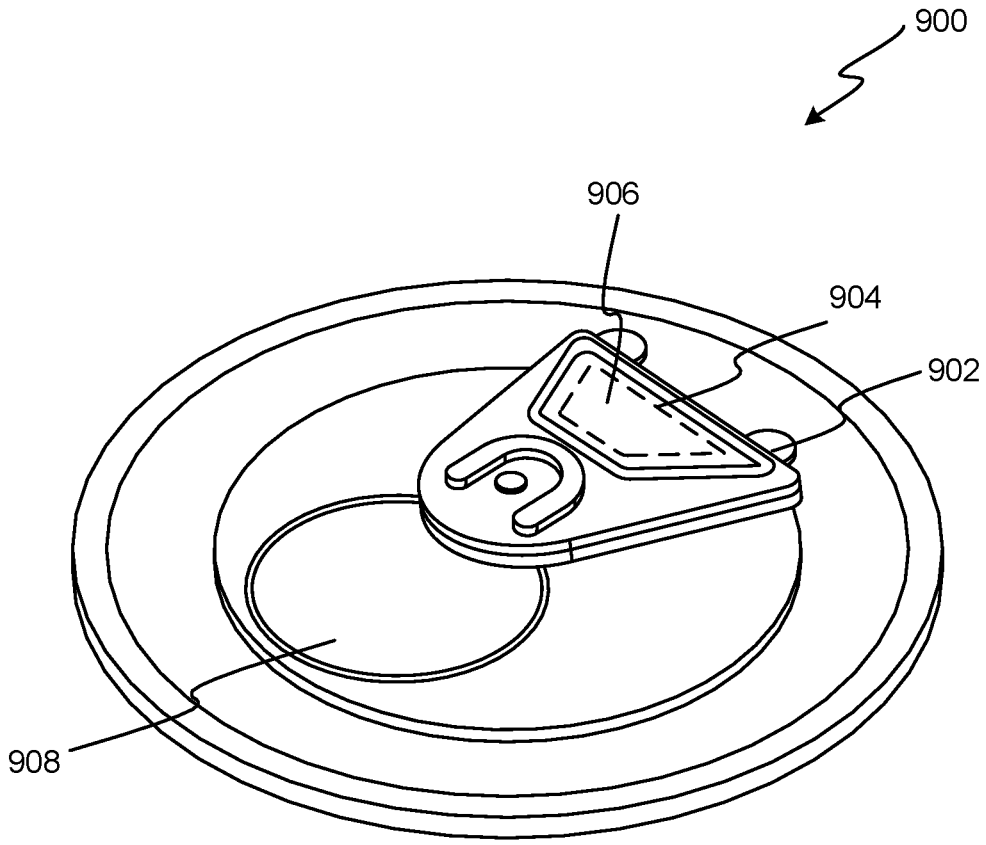
FIG. 9 illustrates a lid of the beverage container having a reservoir for storing a capsule like substance, in accordance with one embodiment of the present disclosure.

Referring to FIG. 9 now, a lid 900 of a beverage container having a pull tab 902 and reservoir 904 for storing a capsule-like substance is shown, in accordance with some embodiment of the present disclosure. The dotted portion present on the pull tab 902 illustrates a reservoir 904. The reservoir 904 stores a capsule that can be used for mixing in a beverage of the beverage container. For example, the capsule can be capsule of caffeine which the user can mix in the beverage to make the beverage caffeinated. The reservoir 904 can have a tray like structure for storing the capsule. However, the shape of the reservoir is not limited to the tray like structure and can include any structure which can accommodate a capsule.

The reservoir 904 can be covered by a sealing element 906. The sealing element 906 can be hard covering (for example, hard plastic) on top of the reservoir 902 so that the edible material inside the reservoir 904 remains airtight. The sealing element 906 can be broken whenever a user desires to mix the caffeinated capsule into the beverage present in the beverage container. Whenever the user desires to consume the beverage present in the beverage container, the pull tab 902 is lifted at an angle such that a mouth 908 of the beverage container can be opened up. Once the mouth is opened, the sealing element 906 can be manipulated (for example, broken), capsule (for example, caffeinated capsule) can be mixed into the beverage of the beverage container.

Figure 10:
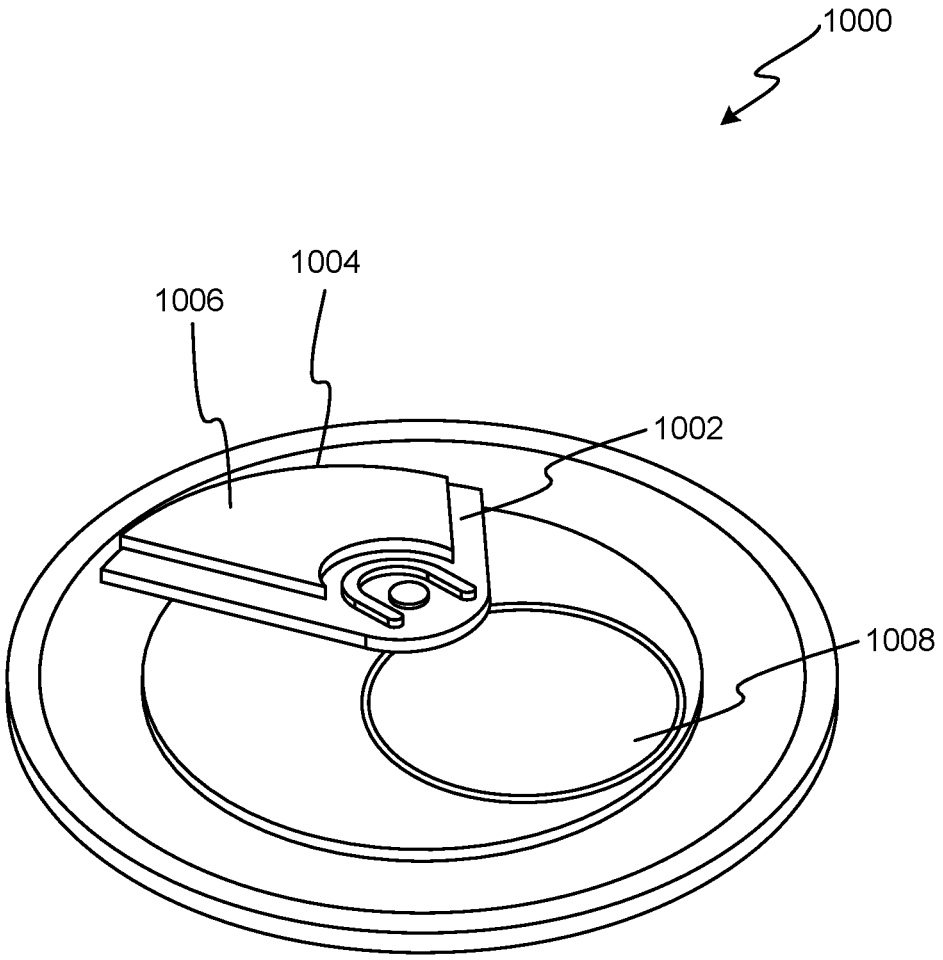
FIG. 10 illustrates a lid of the beverage container showing reservoir in the form of collapsible bellows, in accordance with one embodiment of the present disclosure.

Referring to FIG. 10 now, a lid 1000 of the beverage container showing a pull tab 1002 and a reservoir 1004 in the form of collapsible bellows is shown, in accordance with some embodiment of the present disclosure. The reservoir 1004 has an edible material and is covered by sealing element 1006. The sealing element 1006 is arranged in the form of collapsible bellows. The sealing element 1006 is arranged such that the sealing element can be squeezed from the center of the sealing element 1006. The sealing element 1006 can have an upper layer and a lower layer made of plastic with a flexible material around the perimeter that can flex when the upper layer is pinched. Once the upper layer is pinched, the edible material present in the reservoir 1004 spills out from the reservoir 1004. In one embodiment, the flexibility and thickness of the upper layer and the lower layer can be changed such that the edible material can be dispensed with more pressure directly into the beverage container via a mouth 1008 of the beverage container.

In some of the embodiments, the beverage container 100 cannot include the pull tab 106 and the reservoir 112 can be directly placed on top of the lid 104 of the beverage container 100. For example, the sealing element 114 present on top of the reservoir 112 can be manipulated by different means. In one embodiment, the lid 104 can comprise a sliding element. The sliding element can move from one position of the lid 104 to another position on top of the reservoir 112 such that the sliding element is in contact with the sealing element 114 when the sliding element moves on top of the reservoir 112. The lower portion of the sliding element can include teeth such that when the sliding element is moved on top of the reservoir 112, the sealing element 114 is manipulated using the teeth present on the sliding element.

In one embodiment, the lid 104 can include a push button. The first end of the push button can be in contact with the sealing element 114 present on top of the reservoir 112 while a second end of the push button can be used for manipulating the sealing element 114. A user lifts the second end of the push button which in turn pushes the first end of the push button on top of the sealing element 114 and the sealing element 114 is manipulated. The manipulation enable dispensing of the edible material present in the reservoir 112 into the beverage container 100.

In one embodiment, the sealing element 114 can include locking means. The locking means can be like a barrel slide that opens and permits edible material in the reservoir 112 to dispense. The locking means locks the sealing element 114 in one position. As soon as the user unlocks the sealing element 114 using the locking means, the edible material can be dispensed into the beverage of the beverage container 100. However, the manipulation of the sealing element 114 can be done in any of the ways mentioned above or any other additional ways not mentioned here. In one embodiment, a user can interact with the sliding means, the push button or the locking means not for use (for example, pleasure) other than dispensing the edible material.

Figure 11:
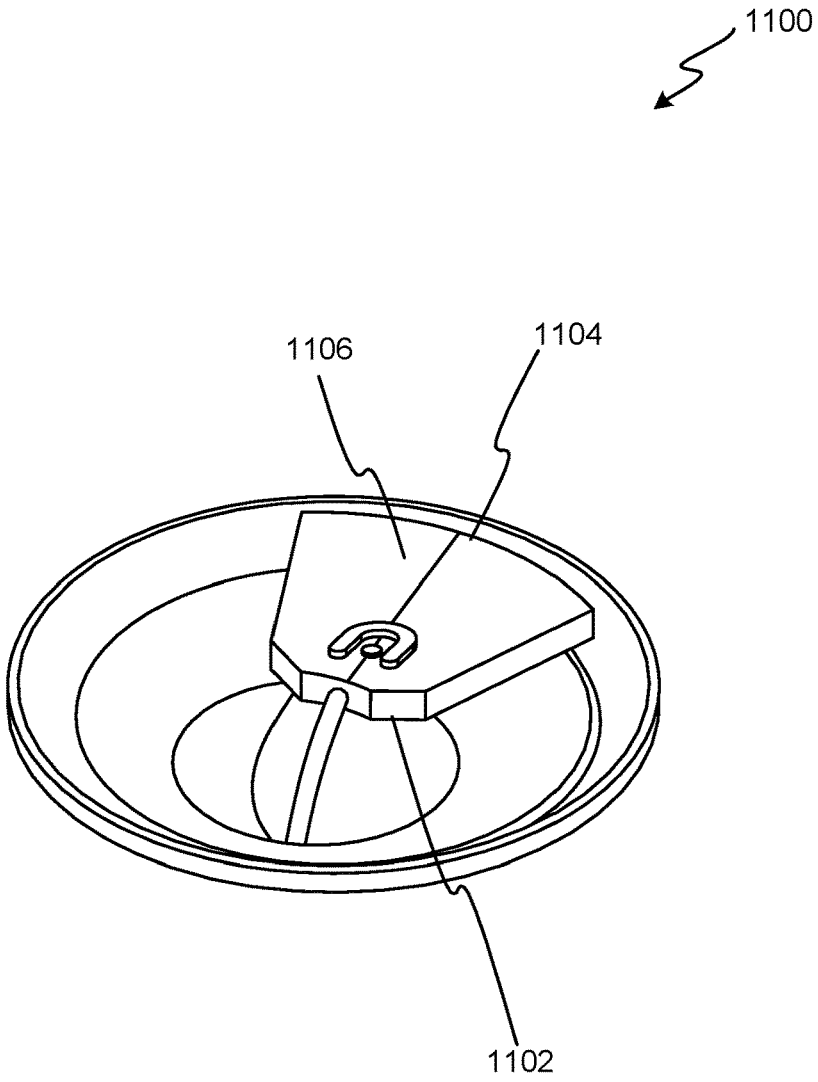
FIG. 11 illustrates a lid with a reservoir for a large size beverage container, in accordance with one embodiment of the present disclosure.

Referring to FIG. 11 now, a lid 1100 having a reservoir 1104 for large size beverage containers are shown, in accordance with some embodiment of the present disclosure. Large size beverage containers are the ones that store more beverage than the regular beverage containers available in the market. Generally, large size beverage containers have a capacity of more than 30 milliliters. For beverage containers having a large size, the lid 1100 and accordingly the pull tab 1102 are also sized large accordingly.

Although a pie-shaped reservoir 1104 is shown, however, the shape of the reservoir 1104 is not limited. The reservoir 1104 has a covering of a sealing element 1106 and a channel for dispensing the edible material present in the reservoir 1104 into the beverage container. The reservoir 1104 has more capacity to hold edible material than the embodiments explained above. Thus, when a user desires to add more edible material into the beverage container 100, the user can use large-sized beverage containers. In the large-sized beverage container, the user can lift the pull tab 1102 at an angle or slide the pull tab 1102 to a different position to open the mouth 108 of the beverage container. The sealing element 1106 can then be manipulated, either by the user, or as a result of lifting/sliding the pull tab 106 and the edible material can be dispensed into the beverage container 100.

Figure 12:
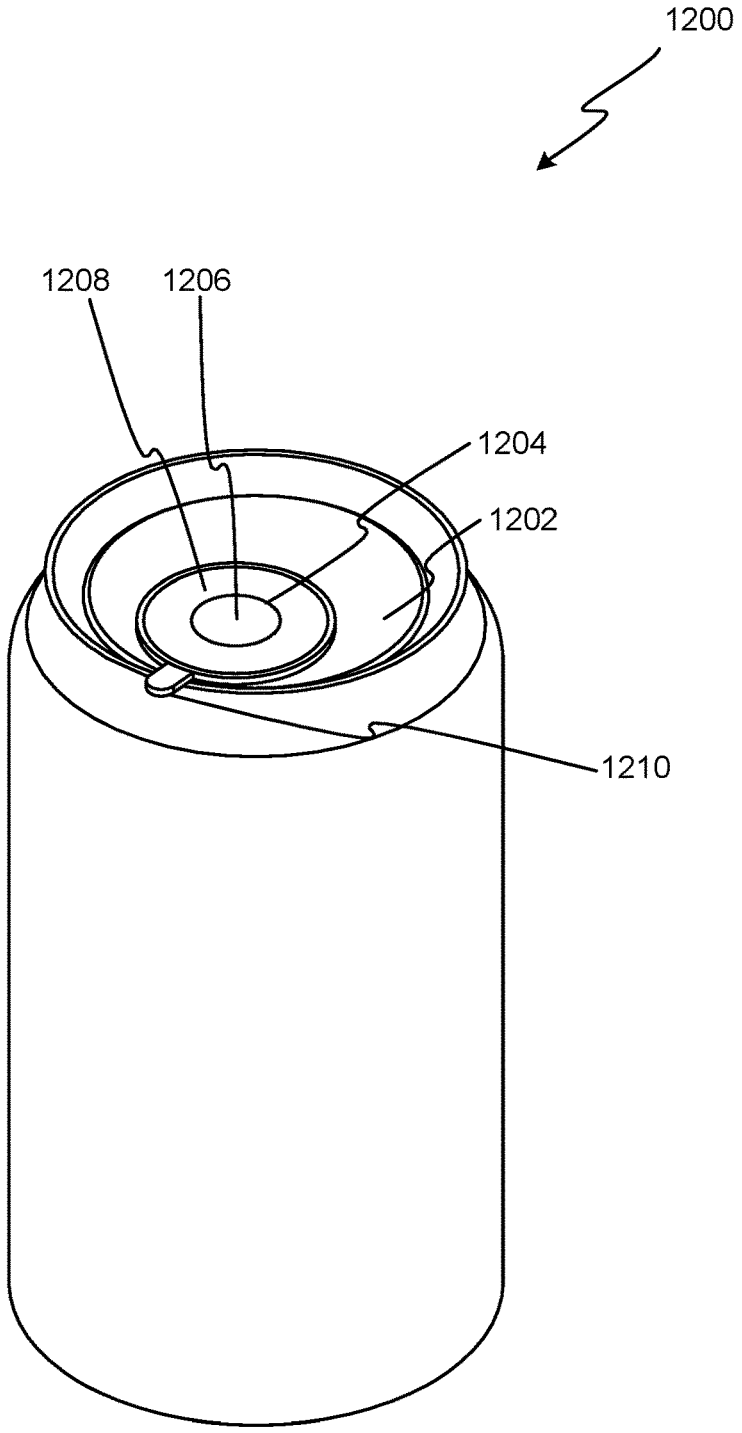
FIG. 12 illustrates a beverage container without pull tab, in accordance with one embodiment of the present disclosure.

Referring to FIG. 12 now, a beverage container 1200 without pull tab is illustrated, in accordance with one embodiment of the present disclosure. The beverage container 1200 comprises a lid 1202 can include a reservoir 1204 for holding the edible material. The reservoir 1204 can be a tub-like structure where either a fluid or a dry substance can be stored. There can be two layers covering the mouth of the beverage container—an inner layer 1206 and an outer layer 1208. The inner layer 1206 comprises the reservoir 1204. The outer layer 1208 comprises a first pulling means 1210 for lifting the outer layer 1208. In one embodiment, the inner layer 1206 has a sealing element for covering the inner layer 1206. In one embodiment, the sealing element has a second pulling means (not shown) present on the inner layer 1206 for pulling the sealing element.

Thus, when a user desires to add edible material into the beverage container, the user can separately open the inner layer 1206 and the outer layer 1208 using the second pulling means and the first pulling means 1210 respectively. For example, the user can lift the inner layer 1206 using the second pulling means and lift the outer layer 1208 using the first pulling means 1210. After opening both the inner layer 1206 and the outer layer 1208, the edible material can be added into the beverage.

Figure 13:
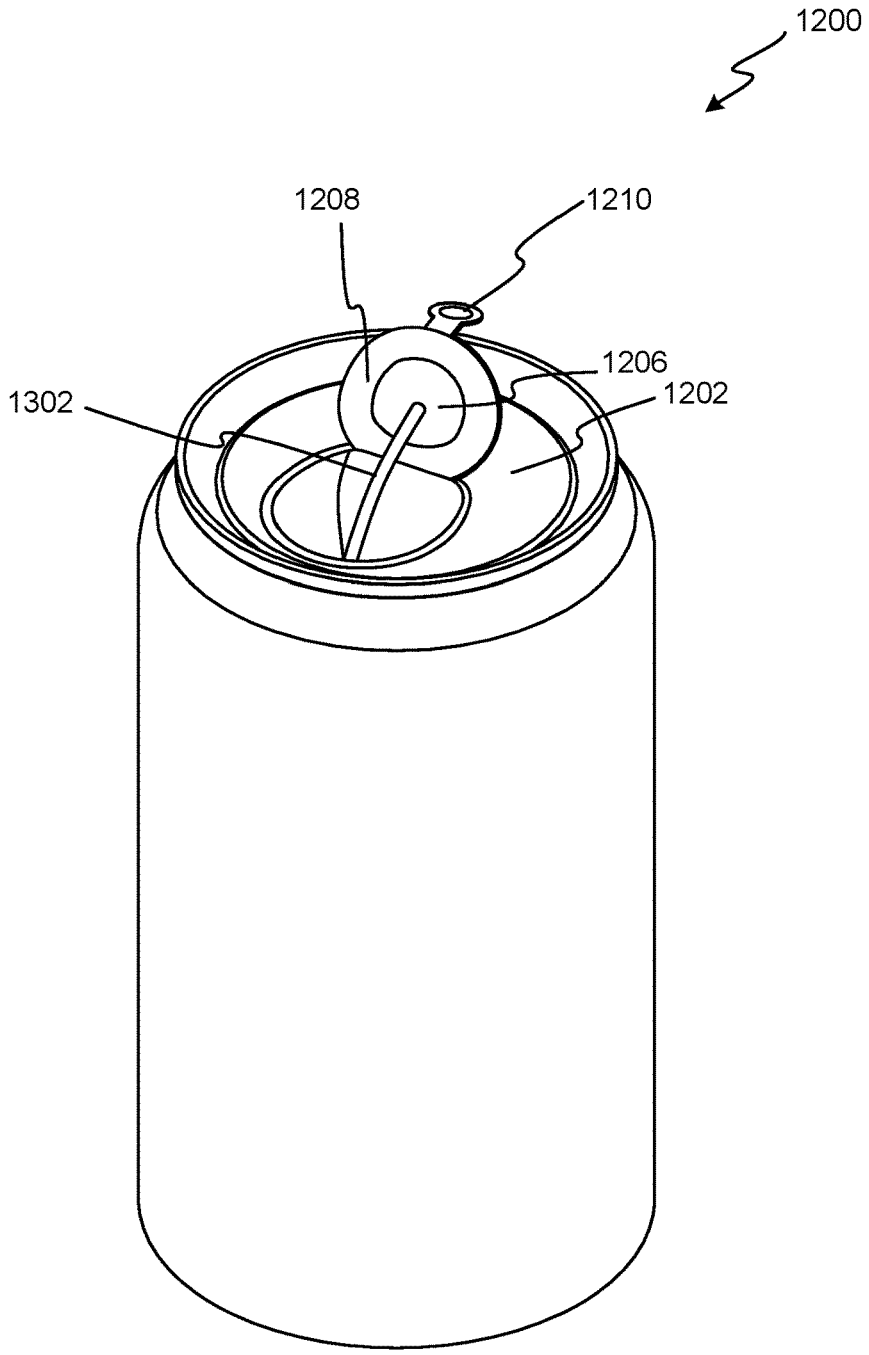
FIG. 13 illustrates a depressing sealing element of a reservoir, in accordance with one embodiment of the present disclosure.
Figure 14:
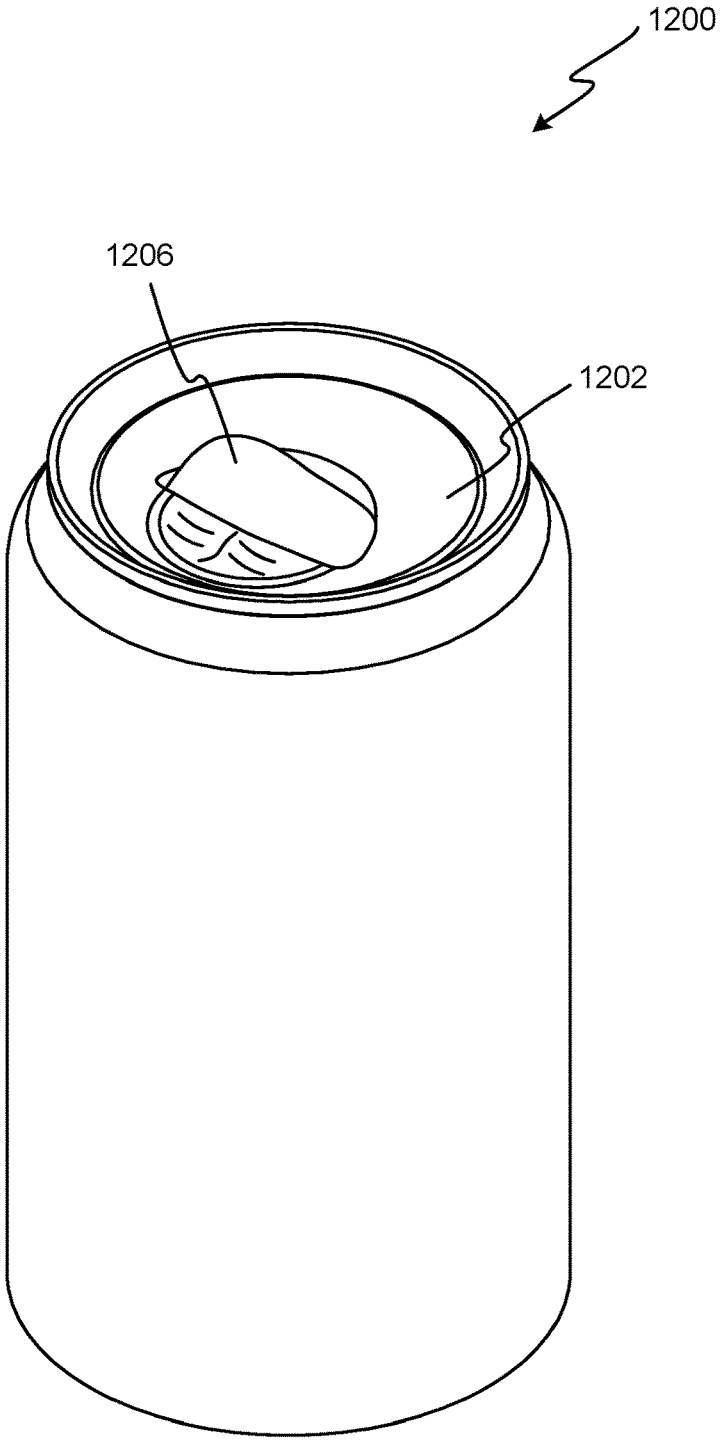
FIG. 14 illustrates a peeling sealing element of a reservoir, in accordance with one embodiment of the present disclosure.

In one embodiment, the inner layer 1206 can be depressed (or pushed) in a downward direction so that the edible material can be dispensed into the beverage container 1200 from the downward direction, as shown in FIG. 13. The inner layer 1206 can be depressed without lifting the first pulling means 1210 is present on the outer layer 1208. Thus, a user can mix the edible material 1302 into the beverage of the beverage container 1200 without opening the beverage container 100. In one embodiment, the inner layer 1206 can be made of tape-like structure, as shown in FIG. 14. The inner layer 1206 can be peeled off from the reservoir 1204 and the edible material can be dispensed into the beverage container 1200.

Figure 15:
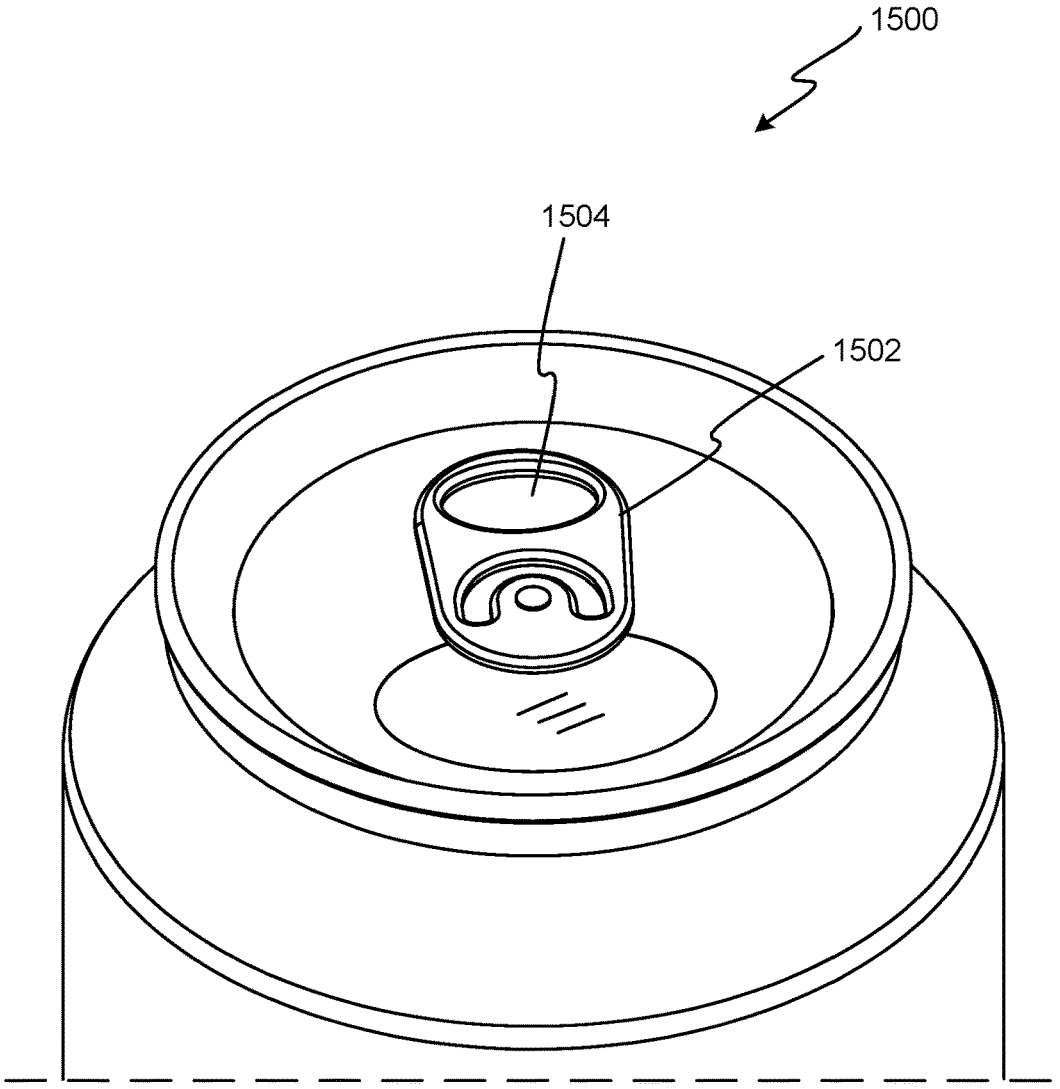
FIG. 15 illustrates placing a reservoir inside a cavity present on the pull tab, in accordance with one embodiment of the present disclosure.

Referring to FIG. 15 now, a lid 1500 with a reservoir and a pull tab 1502 is illustrated, in accordance with some embodiment of the present disclosure. Thus, in place of placing the reservoir on top of the pull tab 1502, a reservoir is placed inside a cavity 1504 present on a pull tab 1502. For example, the reservoir can be placed inside cavity 1504. The reservoir has a sealing layer that can be manipulated, and the edible material present in the reservoir can be dispensed into the beverage container.

The beverage container 100 can be manufactured in a manufacturing unit. The process of manufacturing can be similar to the manufacturing of the regular beverage container excluding that a reservoir with a sealing element is included on the pull tab. The lid of the beverage container can be manufactured independently and can be placed on the beverage container. The tub-like structure in the form of a reservoir and the sealing element on top of the reservoir can be manufactured and placed on top of the lid in a can assembly line. In one embodiment, a user can manually affix the lid, pull tab and/or reservoir on top of the beverage container 100. Channels can be manufactured in the reservoir for dispensing the edible material from the reservoir to the beverage container 100.

Engineered seals made from plastics (or any other material) can be used as sealing elements or applied to the reservoir with heat, or even ultrasonic vibrations and friction as they go through the can assembly line. Different application for a sealed self-contained opening tab will likely have a specifically engineered application for holding the edible material. Since the lid and the pull tab can be manufactured separately, in one embodiment, the edible material can be customized even after canning of the beverage container 100.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a swim diagram, a data flow diagram, a structure diagram, or a block diagram. Although a depiction may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

The methods, systems, devices, graphs, and tables discussed herein are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

While illustrative and presently preferred embodiments of the disclosed systems, methods, and machine-readable media have been described in detail herein, it is to be understood that the inventive concepts may be otherwise variously embodied and employed, and that the appended claims are intended to be construed to include such variations, except as limited by the prior art. While the principles of the disclosure have been described above in connection with specific apparatuses and methods, it is to be clearly understood that this description is made only by way of example and not as limitation on the scope of the disclosure.

What is claimed is:

1. A can-top reservoir for dispensing edible material into a beverage container, the can-top reservoir comprising:

a reservoir, wherein:

the reservoir holds the edible material, different than a beverage of the beverage container, and the reservoir has an egress for selectively dispensing the edible material into a mouth of the beverage container; and a sealing element for sealing the reservoir, wherein:

the sealing element comprises a layer of flexible material such that the layer is adapted to flex when pinched, and when the can-top reservoir is lifted at an angle and the sealing element is pinched, the edible material from the reservoir is dispensed into the beverage via the egress toward the mouth.

2. The can-top reservoir for dispensing edible material into the beverage container, as recited in claim 1, wherein the edible material is a fluid or a dry substance.

3. The can-top reservoir for dispensing edible material into the beverage container, as recited in claim 1, wherein the sealing element is broken when pinched.

4. The can-top reservoir for dispensing edible material into the beverage container, as recited in claim 1, wherein the can-top reservoir is user installable onto the beverage container.

5. The can-top reservoir for dispensing edible material into the beverage container, as recited in claim 1, wherein the can-top reservoir is attached to a lid of the beverage container at manufacture.

6. The can-top reservoir for dispensing edible material into the beverage container, as recited in claim 1, wherein the reservoir has multiple egresses.

7. The can-top reservoir for dispensing edible material into the beverage container, as recited in claim 1, wherein the can-top reservoir acts as an opening lever.

8. A lid for covering a beverage container and dispensing edible material into the beverage container, the lid comprising:

a reservoir, wherein:

the reservoir holds the edible material, different than a beverage of the beverage container, and the reservoir has an egress for selectively dispensing the edible material into a mouth of the beverage container; and a sealing element for sealing the reservoir, wherein the sealing element comprises a layer of flexible material such that the layer is adapted to flex when pinched.

9. The lid for covering a beverage container and dispensing edible material into the beverage container, as recited in claim 8, further comprising a closure tab attached to the lid, wherein:

the reservoir is present on the closure tab; and when the closure tab is lifted at an angle and the sealing element is manipulated, the edible material from the reservoir is dispensed into the beverage via the egress toward the mouth.

10. The lid for covering a beverage container and dispensing edible material into the beverage container, as recited in claim 8, wherein the edible material is a fluid or a dry sub stance.

11. The lid for covering a beverage container and dispensing edible material into the beverage container, as recited in claim 9, wherein the sealing element is broken when pinched.

12. The lid for covering a beverage container and dispensing edible material into the beverage container, as recited in claim 9, wherein the reservoir is user installable onto the beverage container.

13. The lid for covering a beverage container and dispensing edible material into the beverage container, as recited in claim 9, wherein the reservoir is attached to the lid of the beverage container at manufacture of the beverage container.

14. The lid for covering a beverage container and dispensing edible material into the beverage container, as recited in claim 8, wherein the reservoir has multiple egresses.

15. A beverage container for holding a beverage, comprising:

a container body for holding the beverage;

a lid coupled to the container body; and a can-top reservoir, attached to the lid, for opening a beverage container and dispensing edible material into the beverage container, wherein the can-top reservoir comprises:

a reservoir, wherein:

the reservoir holds the edible material, different than the beverage of the beverage container; and the reservoir has an egress for selectively dispensing the edible material into a mouth of the beverage container, and a sealing element for sealing the reservoir, wherein:

the sealing element comprises a layer of flexible material such that the layer is adapted to flex when pinched, and when the can-top reservoir is lifted at an angle and the sealing element is pinched, the edible material from the reservoir is dispensed into the beverage via the egress toward the mouth.

16. The beverage container for holding a beverage, as recited in claim 15, wherein the edible material is a fluid or a dry substance.

17. The beverage container for holding a beverage, as recited in claim 15, wherein the sealing element is broken by lifting to the angle.

18. The beverage container for holding a beverage, as recited in claim 15, wherein the can-top reservoir is user installable onto the beverage container.

19. The beverage container for holding a beverage, as recited in claim 15, wherein the can-top reservoir is attached to the lid of the beverage container during manufacture.

20. The beverage container for holding a beverage, as recited in claim 15, wherein the reservoir has multiple egresses.

* * * * *